US006809610B1

(12) United States Patent
Kern et al.

(10) Patent No.: US 6,809,610 B1
(45) Date of Patent: Oct. 26, 2004

(54) BALANCING NETWORK

(75) Inventors: Stefan Kern, Backnang (DE); Gregor Gerhard, Murrhardt (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/088,368

(22) PCT Filed: Sep. 12, 2000

(86) PCT No.: PCT/IB00/01371

§ 371 (c)(1),
(2), (4) Date: Aug. 7, 2002

(87) PCT Pub. No.: WO01/20709

PCT Pub. Date: Mar. 22, 2001

(30) Foreign Application Priority Data

Sep. 14, 1999 (DE) ..... 199 43 954

(51) Int. Cl.[7] ..... H01P 5/10
(52) U.S. Cl. ..... 333/26; 333/116
(58) Field of Search ..... 333/25, 26, 109, 333/116, 246

(56) References Cited

U.S. PATENT DOCUMENTS 5,886,589 A * 3/1999 Mourant ..... 333/26
6,018,277 A * 1/2000 Vaisanen ..... 333/26
6,441,696 B1 * 8/2002 Westberg ..... 333/26

FOREIGN PATENT DOCUMENTS

EP 0 844 684 A1 5/1998
JP 59148405 8/1984

* cited by examiner

*Primary Examiner*—Robert Pascal
*Assistant Examiner*—Dean Takaoka
(74) *Attorney, Agent, or Firm*—Kirschstein, et al.

(57) ABSTRACT

A balancing network has three planar lines which are coupled together. One end of the first line which runs between the second and the third line acts as an unbalanced gate. The opposite end of the first line is connected to earth, and one end of each of the other two lines forms a balanced gate. The balancing network is decoupled from the direct current source. The ends of the second and third lines, which do not act as gates, are capacitively coupled with one another.

5 Claims, 2 Drawing Sheets

BALANCING NETWORK

BACKGROUND OF THE INVENTION

Figure 1:
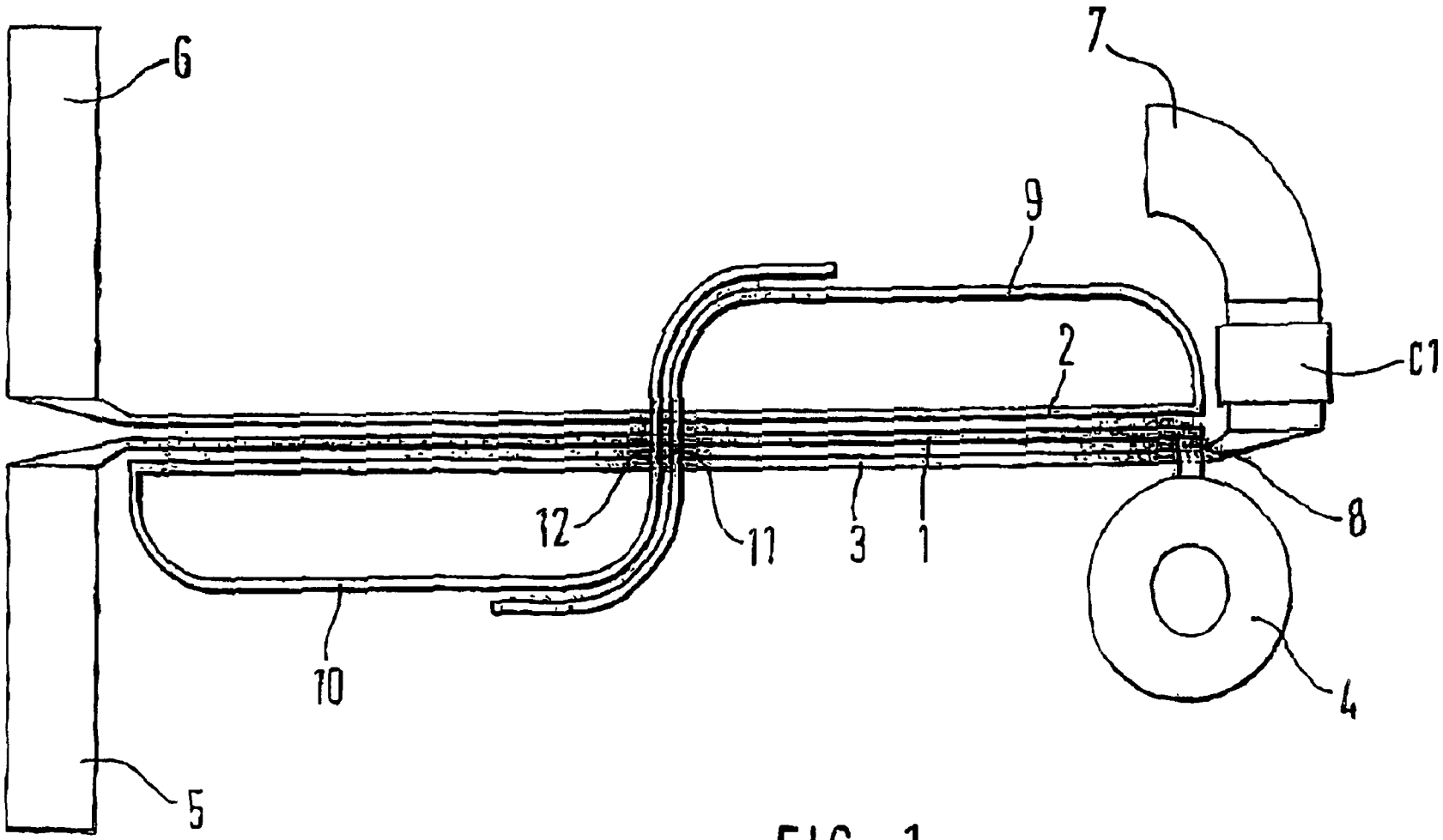

The present invention concerns a balun, consisting of planar lines coupled to each other, in which one end of a first line running between a second and a third line serves as unbalanced signal input and the other end of this first line is contacted with ground and one end each of the other two lines forms a balanced signal input.

Baluns are known to represent transitions between balanced and unbalanced transmission lines. A balanced line exists when the signal transmitted over it does not have ground as reference potential. On the other hand, an unbalanced transmission line is in contact with ground on one side, so that a signal transmitted over it has ground as reference potential. Baluns of this type are used, for example, at the inputs and outputs of quadruplex mixers or amplifiers or modulators, etc. A balun, consisting of three coupled planar lines, is known, for example, from J. Villemazet, J. Dubouloy, M. Soulard, J. Cayrou, E. Husse, B. Cogo, J. Cazaus: New Compact Double Balanced Monolithic Down-Converter Application to a Single Chip MMIC Receiver for Satellite Equipment, IEEE MTT-S Digest, 1998, pages 853–856. An unbalanced gate is situated on one end of the middle of the three lines. The other end of the middle line is connected to ground.

The end of one of the two outer lines lying next to this line end in contact with ground is also in contact with ground, and its other end forms a balanced gate. One end of the other outer line is also in contact with ground, and the other end forms a second balanced gate. In this known balun, three line ends must be contacted with ground, for which purpose several contacts must be provided on a substrate carrying the line, which require relatively much space on the substrate. In order for the inputs of the balun not to be DC short-circuited relative to ground, capacitances must be inserted at all inputs for DC decoupling.

The underlying task of the invention is to provide a balun of the type just mentioned, in which DC decoupling is accomplished with the simplest possible means.

SUMMARY OF THE INVENTION

The mentioned task is solved with the features of Claim 1, in that, of the three planar lines connected to each other, one end of a first line running between a second and a third line serves as unbalanced gate and the other end of this first line is contacted with ground, and one end each of the other lines forms a balanced gate. DC decoupling is achieved by the fact that the ends of the secondhand third lines not serving as gates are capacitively coupled to each other.

As can be deduced from the subclaims, capacitive coupling of the line end can be accomplished very simply by the fact that the ends of the second and third lines are connected to line sections that run next to each other over a stipulated length, or by the fact that the ends of the second and third lines are connected to each other via one or more capacitors. It is expedient to connect a capacitor in series with the third line. This capacitor improves the balance between the balanced gates. It serves to balance the phase difference at 180°.

DRAWING

Figure 2:
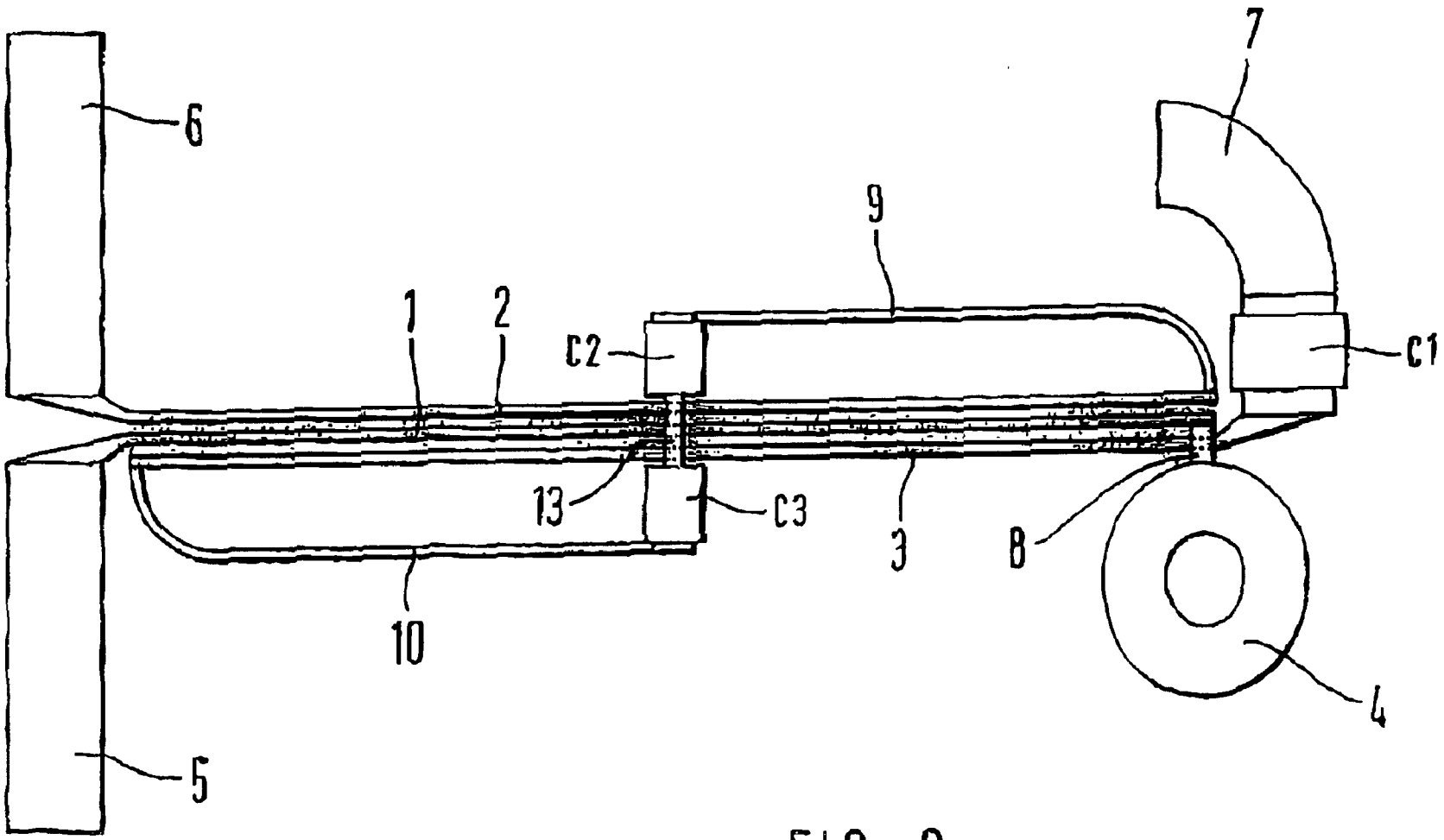

The invention is now further explained with reference to two practical examples depicted in the drawing. In the drawing:

FIG. 1 shows a balun, in which two lines are capacitively coupled to each other by parallel guiding, and FIG. 2 shows a balun, in which two lines are coupled to each other via concentrated capacitors.

DETAILED DESCRIPTION OF THE PREFERRED EMBODIMENTS

The balun depicted in FIG. 1 consists of three planar lines 1, 2 and 3 running next to each other and coupled to each other. The coupling length of these three lines corresponds to about one-fourth of the average operating wavelength of the balun. The first line 1, which runs between the two other lines 2 and 3, is contacted with ground on one end. For this purpose, a contact 4 to the ground surface is provided on the bottom of the substrate on which the lines are applied. The opposite end of this first line 1 forms an unbalanced gate 5. The end of the second line 2 adjacent to this unbalanced gate 5 is a first gate for balanced signals, and the second gate 7 for balanced signals is situated on the end of the third line 3 that is adjacent to the ground connection of the first line 1.

The connection between the ground-contacted end of the first line 1 to contact 4 occurs via an air gap 8 that spans the end of the third line 3 without contact. The ends of the second line 2 and the third line 3 opposite gates 6 and 7 are each connected to a line section 9, 10. The line sections 9 and 10 that are adjacent to each other at opposite ends of the two lines 2 and 3 are returned in space-saving fashion to the center of the balun and run next to each other over a stipulated length, in which they cross the three lines 1, 2, 3 via air gaps 11 and 12 without contact. The coupling length of the two line sections 9 and 10 is chosen so that a desired capacitive coupling is produced between the ends of the two lines 2 and 3. This capacitive coupling of the two lines 2 and 3 means that the balun is DC-decoupled.

As shown in FIG. 1, a capacitor C1 is connected in series to the third line 3 in the region of gate 7. This capacitor C1 improves the balance between the balanced gates 6 and 7. It serves to balance the phase difference between the two gates 6 and 7 at 180°.

A balun is depicted in FIG. 2 that has essentially the same design as the balun of FIG. 1 and therefore also the same reference numbers. The practical examples of a balun depicted in FIGS. 1 and 2 differ in the type of capacitive coupling between the ends of the two lines 2 and 3. Whereas, according to the practical example in FIG. 1, capacitive coupling occurs via a line coupling between line sections 9 and 10, in the balun according to FIG. 2 the two line sections 9 and 10 are connected to each other via two capacitors C2 and C3, designed as concentrated components. The two capacitors C2 and C3, connected to the ends of the line sections 9 and 10, which are arranged on both sides of the lines 1, 2 and 3 coupled to each other, are connected to each other via an air gap 13 that crosses the three lines 1, 2, and 3 without contact. Instead of two capacitors, only one capacitor can also be inserted between the line sections 9 and 10.

What is claimed is:

1. A balun, comprising: a plurality of planar lines coupled to each other, one end of a first of the lines interposed between a second of the lines and a third of the lines serving as an unbalanced gate, the other end of the first line being connected to ground, one end of each of the second and third lines serving as a balanced gate, and the other ends of the second and third lines, not serving as gates, being capacitively coupled to each other.

2. The balun according to claim 1, wherein, for capacitive coupling, the other ends of the second and third lines are connected to line sections that run next to each other over a stipulated length.

3. The balun according to claim 1, wherein, for capacitive coupling, the other ends of the second and third lines are connected to each other via at least one capacitor.

4. The balun according to claim 1, and a capacitor connected in series to the third line.

5. The balun according to claim 1, wherein the first, second and third lines coupled to each other have a coupling length of about one-fourth of an average operating wavelength of the balun.

* * * * *

UNITED STATES PATENT AND TRADEMARK OFFICE

CERTIFICATE OF CORRECTION

PATENT NO. : 6,809,610 B1
APPLICATION NO. : 10/088368
DATED : October 26, 2004
INVENTOR(S) : Kern et al.

It is certified that error appears in the above-identified patent and that said Letters Patent is hereby corrected as shown below:

In Column 1, Lines 29-39, delete "The end of one of the two outer lines. . . . . for DC decoupling." and insert the same in line 28, after "ground." as a continuation.

In Column 1, Line 52, delete "secondhand" and insert -- second and --, therefor.

In Column 1, Line 64, delete "DRAWING" and insert -- BRIEF DESCRIPTION OF THE DRAWINGS --, therefor.

Signed and Sealed this

Thirtieth Day of December, 2008

JON W. DUDAS
*Director of the United States Patent and Trademark Office*